US007096843B2

(12) United States Patent
Kawamoto et al.

(10) Patent No.: US 7,096,843 B2
(45) Date of Patent: Aug. 29, 2006

(54) MULTICYLINDER FOUR-CYCLE COMBUSTION ENGINE

(75) Inventors: Yuichi Kawamoto, Akashi (JP); Tomoyuki Terao, Kobe (JP); Matsuhiro Asano, Kobe (JP); Yoshiharu Matsuda, Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 24 days.

(21) Appl. No.: 10/928,667

(22) Filed: Aug. 27, 2004

(65) Prior Publication Data

US 2005/0045121 A1 Mar. 3, 2005

(30) Foreign Application Priority Data

Aug. 27, 2003 (JP) ..... 2003-302862

(51) Int. Cl.
*F02F 7/00* (2006.01)

(52) U.S. Cl. ..... 123/195 R; 123/311; 123/58.1

(58) Field of Classification Search ..... 123/195 R, 123/311, 58.1
See application file for complete search history.

(56) References Cited

FOREIGN PATENT DOCUMENTS

JP 11-182325 6/1999

*Primary Examiner*—Tony M. Argenbright
*Assistant Examiner*—Katrina B. Harris

(57) ABSTRACT

There is provided a multicylinder four-cycle combustion engine, in which a communication hole is formed, to allow gases to flow smoothly form one cylinder to another so that the pumping loss occurring within the cylinders can be reduced. The combustion engine (E) includes an engine casing (EC) having defined therein a plurality of cylinders (2A to 2D), each having a cylinder bore (20A to 20D), and a crank chamber (30A to 30D) below the respective cylinder bore. A partition wall (21) separating the neighbor cylinder bores (20A, 20B; 20C, 20D) of the cylinders (2A to 2D) and the crank chambers (30A to 30D) from each other is formed with a communication hole (4). An open edge portion (4*aa*) of the uppermost edge (4*a*) thereof, which opens into the cylinder bore (20A to 20D) has a circumferentially intermediate major portion extending in a direction substantially perpendicular to the cylinder longitudinal axis (CH).

19 Claims, 6 Drawing Sheets

MULTICYLINDER FOUR-CYCLE COMBUSTION ENGINE

BACKGROUND OF THE INVENTION

1. Field of the Invention

The present invention generally relates to a multicylinder four-cycle combustion engine for use primarily in motorcycles and, more particularly, to the multicylinder four-cycle combustion engine of a kind in which the piston pumping loss can be reduced.

2. Description of the Prior Art

In order to reduce the number of component parts of the multicylinder four-cycle combustion engine and, also, to reduce the number of manufacturing steps, it is well known that some of multicylinder four-cycle combustion engines currently used in motorcycles are of a structure in which a cylinder block and a generally upper half of a crankcase are formed integrally with each other. In the case of such multicylinder four-cycle combustion engine, crank chambers one for each cylinder are separated from each other by means of partition walls. Therefore, in order to alleviate the piston pumping loss which would result from as a result of compression of an air within each of the crank chambers that takes place as the corresponding piston moves, the design has been employed, in which the crank chambers for the neighboring cylinders are communicated with each other by means of a communication hole open at one end with an upper or lower portion of one crank chamber and at the other end with an upper or lower portion of the other crank chamber. Each of those communication holes has a round section and is formed by the use of a drilling technique, in which a generally elongated drill is inserted from a position laterally of an engine casing in a direction parallel to the longitudinal axis of the crankshaft, so as to extend transversely between the neighboring crank chambers. See, for example, the Japanese Laid-open Patent Publication No. 11-182325.

In the known multicylinder four-cycle combustion engines of the structure discussed above, since each communication hole is formed by the use of a drilling technique, it has been found that burrs tend to be formed around the leading end of the respective communication hole with respect to the direction of advance of the drill, through which the tip of the drill emerges outwardly. In order to prevent the piston ring from interfering with the burrs so formed and appearing in the inner peripheral wall of the corresponding cylinder bore, the position of each of the communication holes has necessarily and carefully be chosen so that the uppermost edge of the respective communication hole with respect to the direction of movement of the associated piston be located 3 mm or more spaced downwardly from the lowermost end of the piston ring when the piston is held in the bottom dead center position.

Thus, the position of the uppermost edge of the respective communication hole is necessarily limited to a location distant from the lowermost end of the associated piston ring when the piston is held in the bottom dead center position and, on the other hand, the lowermost edge of the respective communication hole must be positioned at a location sufficient to avoid interference with a crank shaft bearing. Those design requirements impose limitations on the size of the leading open end of the respective communication hole, particularly the size of the leading open end as measured in a direction conforming to the direction of reciprocating movement of the piston or a vertical direction.

Since each of the communication holes has a round section as discussed above, the size of the open end in the vertical direction for a given cross-sectional surface area (passage area) of the respective communication hole tends to be large, and accordingly, it is difficult to secure a sufficient passage area for the communication hole under the limitations on such vertical size. Moreover, the presence of the burrs around the open end of the communication hole tends to impose a relatively large resistance to the flow of gases through the communication hole.

Partly because of the insufficient passage area for each communication hole and partly because of the relatively large resistance to the gas flow caused by the burrs, the gases would not flow smoothly therethrough, resulting in increase of the pumping loss. Also, openings through which the drill has been inserted to form the respective communication holes, are left in the lateral portions of the engine casing and, therefore, those openings must be closed by separately prepared plugs, resulting in increase of the number of component parts used and, also, the member of assembling steps.

SUMMARY OF THE INVENTION

In view of the foregoing, the present invention is intended to provide a multicylinder four-cycle combustion engine of a type, in which communication holes effective to allow gases to smoothly flow from one cylinder bore to another can be formed easily and in which the piston pumping loss can advantageously be reduced.

In order to accomplish the foregoing object, the present invention provides a multicylinder four-cycle combustion engine, which includes an engine casing having defined therein a plurality of cylinders, each having a cylinder bore, and a crank chamber below the respective cylinder bore. The cylinders are juxtaposed in a direction parallel to a longitudinal axis of a crankshaft, the neighboring cylinder bores and crank chambers being separated from each other by means of a partition wall. The partition wall has a communication hole formed therein so as to extend completely across the partition wall. A major portion of an open edge portion of an uppermost edge of the communication hole at a circumferentially intermediate portion, which open edge portion opens towards the cylinder bore, extends in a direction substantially perpendicular to a longitudinal axis of the cylinder.

According to the present invention, since the major portion of the open edge portion of the uppermost edge of the communication hole, which opens into the cylinder bore, extends in a direction substantially perpendicular to the cylinder longitudinal axis, for example, horizontally, the passage area of the communication hole relative to the size thereof as measured in a direction conforming to the longitudinal axis of the cylinder can advantageously be increased as compared with the round sectioned communication hole. As a result thereof, the passage area, i.e., the cross-sectional surface area of the communication hole can be increased so that gases beneath the reciprocating piston at the end of descent of the reciprocating piston can advantageously be directed smoothly through the communication hole into the adjoining crank chamber. In view of this, the pumping loss within the cylinder can be reduced with the engine output and efficient consequently increased advantageously.

The communication hole may be formed by the use of a milling technique. In this case, unlike the communication hole formed by the use of a drilling technique, formation of the burrs can advantageously be suppressed and hence, a relatively large size of the communication hole as measured in a direction conforming to the longitudinal axis of the cylinder can be secured with the uppermost edge of the communication positioned as close to the piston ring as possible.

In a preferred embodiment of the present invention, the major portion of the open edge portion of the uppermost edge of the communication hole at the circumferentially intermediate portion may be substantially straight. This straight major portion may preferably have a width which is equal to ½ or more of the total width of the open edge portion.

In another preferred embodiment of the present invention, the uppermost edge of the communication hole may be made up of opposite inclined surface areas, which are flared outwardly, and a horizontal surface area continued between the inclined surface areas, when viewed in a cross-section taken along a plane containing respective longitudinal axes of the neighboring cylinders. According to this design feature, the gases within one of the neighboring cylinder bores can flow into the other of the neighboring cylinder bores smoothly through the communication hole past the inclined surface areas thereof.

In a further preferred embodiment of the present invention, the open edge portion of the lowermost edge of the communication hole, which opens towards the cylinder bore has a circumferentially intermediate major portion that may extend in a direction substantially perpendicular to the longitudinal axis of the cylinder.

According to the foregoing design feature, since the open edge portion of the lowermost edge of the communication hole can extend substantially horizontally as well, the passage area thereof can advantageously be increased enough to further reduce the pumping loss. The circumferentially intermediate major portion referred to above is preferably substantially straight.

In a still further preferred embodiment of the present invention, the communication hole may be formed by milling with a milling tool inserted into the cylinder bore in a direction inclined relative to the longitudinal axis of the cylinder bore.

Formation of the communication hole by milling with a milling tool inserted in the manner described above is effective in that not only can the need to form a special opening other than the cylinder bore for removable insertion of the milling tool during the milling process be dispensed with, but also no extra plug member is needed to close such special opening. Because of this, the process of milling to form the communication hole can advantageously be simplified and can efficiently be executed at a minimized cost.

Where the milling tool is employed in the form of, for example, an end mill cutter, the intended milling operation can easily be achieved by inserting into the cylinder bore the end milling cutter from above or below in a direction inclined relative to the longitudinal axis of the cylinder bore to provide a chamfered surface. Moreover, formation of the communication hole by milling the partition wall from left and right is effective to substantially completely eliminate an undesirable formation of burrs.

The uppermost edge of the communication hole may be formed by means of the end mill cutter mentioned above and the lowermost edge thereof may be formed by means of a ball end mill cutter.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, the present invention will be described in detail in connection with a preferred embodiment thereof with reference to the accompanying drawings.

Figure 1:
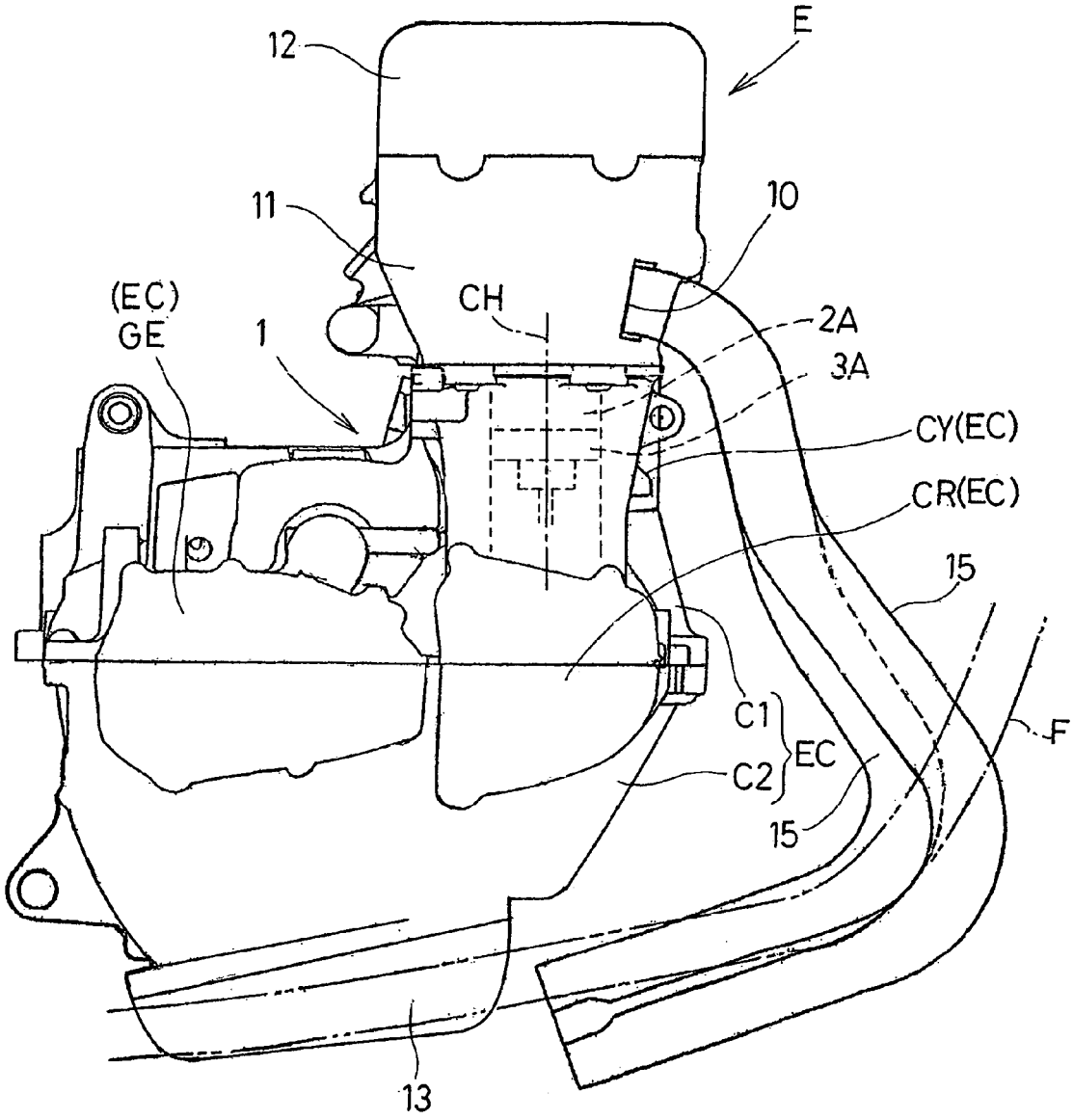
FIG. 1 is a side view of an essential portion of a multicylinder four-cycle combustion engine according to a preferred embodiment of the present invention.

Referring first to FIG. 1, there is shown a side view of an essential portion of a multicylinder four-cycle internal combustion engine E for use in a motorcycle according to the present invention. The combustion engine is shown as fixedly mounted on a motorcycle frame structure F and is in the form of a four-cylinder, four-cycle internal combustion engine. The illustrated combustion engine E includes an engine body 1, which in turn includes an engine casing EC made up of a crankcase CR, a cylinder block CY and a gear case GE. The engine casing EC is of a two-piece construction including an upper casing component C1 and a lower casing component C2. The cylinder block CY, an upper half portion of the crankcase CR and an upper half portion of the gear case GE integrally are formed in the upper casing component C1 while a lower half portion of the crankcase CR and a lower half portion of the gear case GE are integrally formed in the lower casing component C2.

A cylinder head 11 is fixedly mounted atop the cylinder block CY, and a cylinder head cover 12, with a valve chamber defined therein, is in turn mounted fixedly on a top surface of the cylinder head 11. An oil reservoir or oil pan 13 is secured to an undersurface of the lower casing component C2. As indicated above, the engine casing EC, the cylinder head 11, the cylinder head cover 12 and the oil pan 13 altogether constitute the engine body 1. It is to be noted that the cylinder head 11 has a plurality of, for example, four exhaust ports 10 defined therein, which are in turn communicated with respective exhaust pipes 15.

Figure 2:
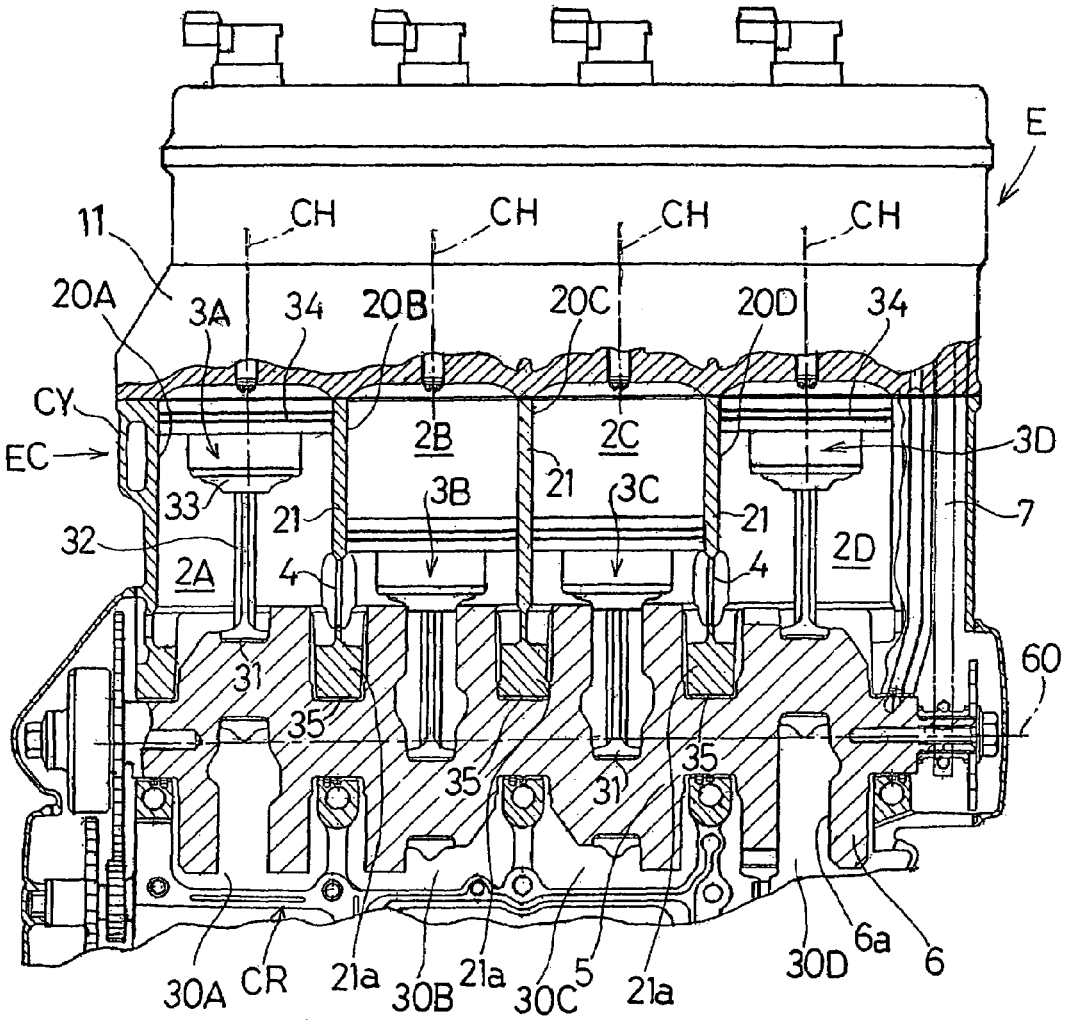
FIG. 2 is a fragmentary front sectional view of that essential portion of the multicylinder four-cycle combustion engine, as viewed from front of such combustion engine.

Referring to FIG. 2, the engine casing EC has four cylinders 2A, 2B, 2C and 2D defined therein by adjoining cylinder bores 20A, 20B, 20C and 20D and also adjoining crank chambers 30A, 30B, 30C and 30D with partition walls 21 separating the crank chambers 30A to 30D and the cylinder bores 20A to 20D. Reciprocating pistons 3A, 3B, 3C and 3D are displaceably accommodated respectively within the cylinder bores 20A to 20D of the cylinders 2A to 2D. The reciprocating pistons 3A to 3D reciprocatingly move within the corresponding cylinder bores 20A to 20D in a predetermined phase displaced relationship with each other. Each of those reciprocating pistons 3A to 3D are drivingly connected with a crankshaft 5 by means of a respective connecting rod 32 having a small end 33 rotatably secured to the respective reciprocating piston 3A to 3D by means of a piston pin (not shown) and also having a big end 31 rotatably connected with the crankshaft 5. The crankshaft 5 is formed with webs 6 each including a balancing weight 6*a*.

The engine casing EC has one end portion formed with a chain tunnel 7 defined therein for accommodating a substantially endless chain forming a part of a valve drive mechanism (not shown) housed within the valve chamber. Each of the reciprocating pistons 3A to 3D has piston rings 34 mounted thereon. Each of the partition walls 21 dividing the crank chamber 30A to 30D and the cylinder bores 20A to 20D has a lower portion formed integrally with a boss portion 21*a* for housing a crankshaft bearing 35.

The neighboring cylinders 2A and 2B, 2C and 2D are communicated with each other by means of respective communication holes 4 each formed in the associated partition wall 21 by the use of a machining technique. Specifically, each of the communication holes 4 is positioned in a lower region of the corresponding partition wall 21 and is so formed as to extend through a lower portion of the corresponding cylinder block CY and an upper portion of the crankcase CR in a direction parallel to the longitudinal axis 60 of the crankshaft 5.

Figure 3:
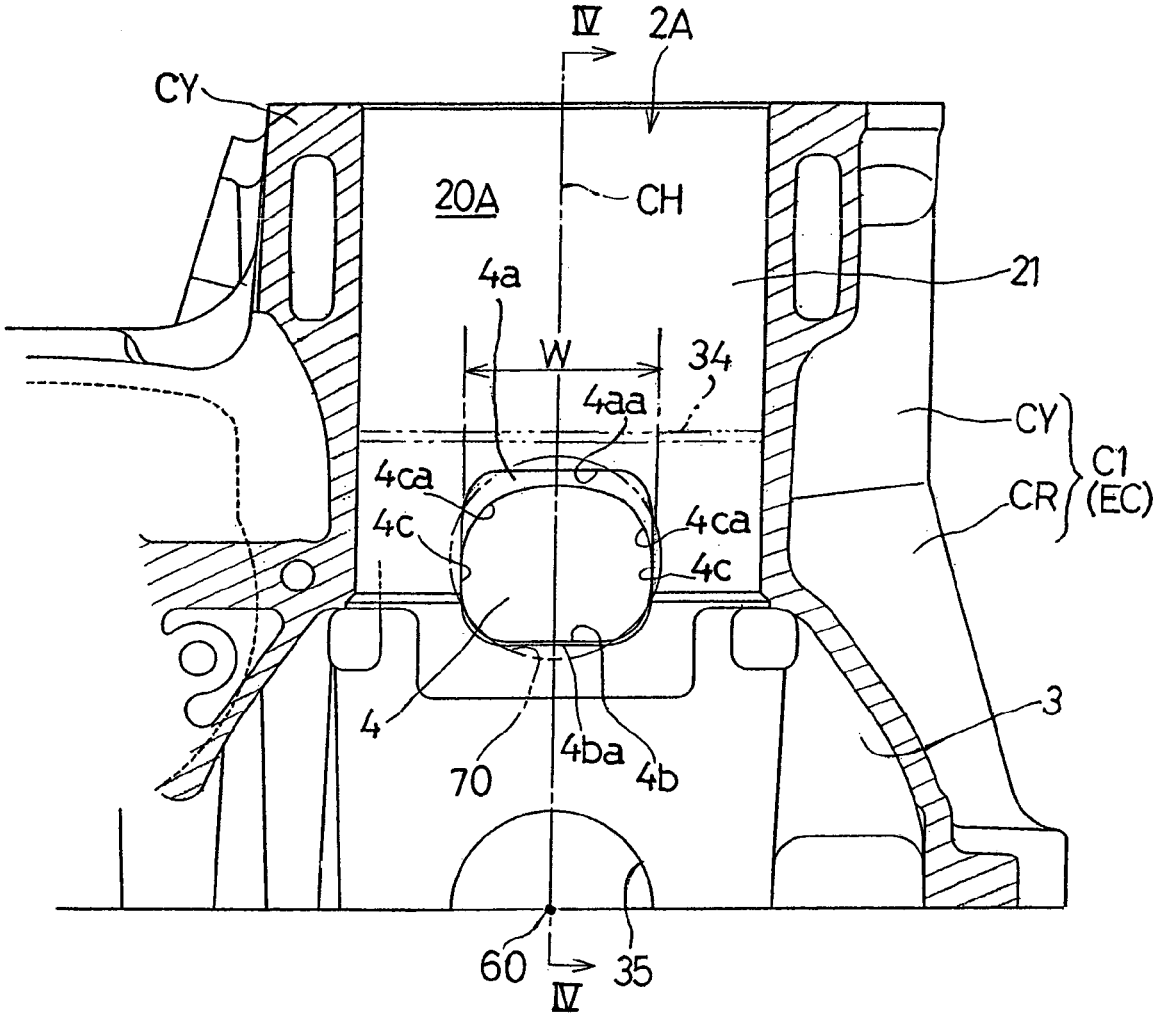
FIG. 3 is a fragmentary side sectional view, on an enlarged scale, of one of engine cylinders of the multicylinder four-cycle combustion engine, showing a corresponding communication hole formed therein.

As best shown in FIG. 3, each of the communication holes 4 has uppermost and lowermost edges 4*a* and 4*b*, which are opposite to each other in a direction conforming to the direction of movement of the piston or a direction parallel to the longitudinal axis CH of the cylinder, and opposite side edges 4*c* and 4*c* continued between the uppermost and lowermost edges 4*a* and 4*b*.

As best shown in FIG. 3, when each of the communication holes 4 is viewed in a radial direction of the cylinder bore 20A, an open edge portion 4*aa* of the uppermost edge 4*a* of the communication hole 4, which opens towards the cylinder bore 20A has an intermediate primary portion along the circumferential direction of the cylinder bore 20A, which extends in a direction perpendicular to the longitudinal axis of the cylinder bore 20A, that is, the longitudinal axis CH of the cylinder 2A. In other words, the open edge portion 4*aa* referred to above represents a substantially horizontal straight portion extending a distance that is ½ or more, preferably ⅔ or more of the total width W of the respective communication hole 4. Each of the distance and the width W referred to above is a dimension measured along a straight line and not along the cylindrical periphery of the cylinder bore 20A.

Similarly, an open edge portion 4*ba* of the lowermost edge 4*b* of each communication hole 4, which opens towards the cylinder bore 20A has an intermediate primary portion along the circumferential direction of the cylinder bore 20A, which extends in a direction perpendicular to the cylinder longitudinal axis CH, and represents a substantially straight portion extending a distance that is ½ or more, preferably ⅔ or more of the total width W of the respective communication hole 4. In view of the shape of a machining tool as will be described later with reference to FIG. 5, respective portions of the opposite side edges 4*c* and 4*c* have open edge portions 4*ca* and 4*ca* that are rounded.

As described above, each communication hole 4 has the open edge portions 4*aa* and 4*ba*, major portions of which lie substantially straight, and has an open end of a configuration delimited by all open edge portions 4*aa*, 4*ba* and 4*ca*. This open end of the communication hole 4 represents a generally rectangular shape having a width greater than the height thereof. Accordingly, it is possible to secure a relatively large passage area, even though the size of the open end of each communication hole as measured in a direction conforming to the longitudinal axis CH of the cylinder 2A is limited by the lowermost piston ring 34 and the boss portion 21*a* housing the crankshaft bearing 35 therein, both shown in FIG. 2.

Figure 4:
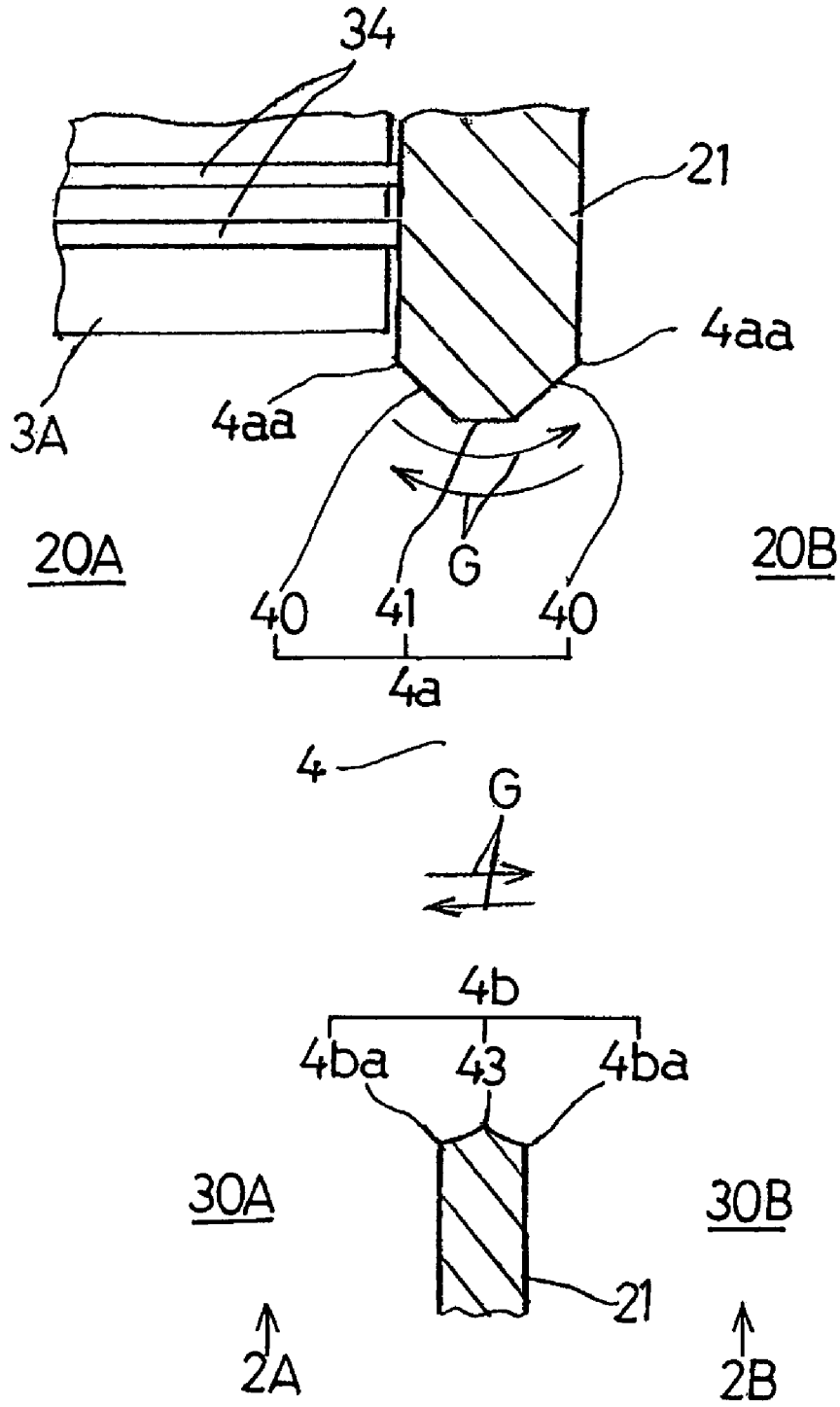
FIG. 4 is a fragmentary sectional view, on a further enlarged scale, taken along line IV—IV in FIG. 3, where the communication hole is formed.

The longitudinal sectional representation of each communication hole 4 (FIG. 3) is shown in FIG. 4 which is the cross sectional view taken along line IV—IV in FIG. 3 containing the respective longitudinal axes CH and CH of the neighboring cylinders 2A and 2B or 2C and 2D. In FIG. 4, the communication hole 4 communicating between the first and second cylinders 2A and 2B is shown as a representative example. As shown therein, the uppermost edge 4*a* of the communication hole 4 is made up of inclined surface areas 40 and 40, which are inclined so as to flare outwardly towards the neighboring cylinder bores 20A and 20B, and a substantially horizontal surface area 41 continuing between the inclined surface areas 40 and 40. Each of the inclined and horizontal surface areas 40 and 41 represents a straight shape so far as shown in FIG. 4 in a longitudinal sectional representation. On the other hand, the lowermost edge 4*b* of the communication hole 4 is delimited by curved surface areas that are symmetrical with each other, leaving a ridge 43 at a center portion thereof with respect to the leftward and rightward direction, that is, a center portion of the direction of flow of gases G so as to protrude towards the center of the communication hole 4.

The flow of the gases G in each communication hole 4 is considerably affected by the size of the open edge portions 4*aa*, 4*ba* and 4*ca* which define respective portions of the inflow port for the gases G. This will now be discussed with reference only to the first cylinder 2A for the sake of brevity.

The gases G within the cylinder 2A, which is urged downwardly as a result of a descending motion of the associated reciprocating piston 3A shown in FIG. 4 flow into the communication hole 4 past the open edge portion 4*aa* of the uppermost edge 4*a* of the communication hole 4 and then into the adjacent cylinder 2B. At this time, the inclined surface areas 40 are effective to allow the gases G to smoothly flow through the communication hole 4. Considering that each of the communication holes 4 extends a small distance, having a small length, the cross-sectional surface area (passage area) of the respective communication hole 4 is substantially governed by the cross-sectional surface area at the open edge portions 4*aa*, 4*ba* and 4*ca* (FIG. 3) of the communication hole 4.

It is to be noted that the circle 70 shown in FIG. 3 by the double dotted lines represents the conventionally utilized communication hole of a round cross-section having the same cross-sectional surface area as that defined by the open edge portions 4*aa*, 4*ba* and 4*ac* of the communication hole 4. As shown therein, it is clear that the conventionally utilized communication hole 70 has a relatively large size at the leading open end thereof as measured in a direction conforming to the longitudinal axis CH of the cylinder 2A and, therefore, has a problem in that it will interfere with the piston ring 34, shown in FIG. 2, and the boss portion 21*a* housing the crankshaft bearing 35.

Hereinafter, the manner in which each of the communication holes 4 is formed will be described in detail with reference to FIG. 5. As shown therein, the machining tool such as an elongated end mill cutter 8 having a flat milling tip 8*a* is inserted from above into, for example, the cylinder bore 20A of the first cylinder 2A at one end of the upper casing component C1, with the milling tip 8*a* oriented in a direction rightwardly diagonally downwardly towards the lower region of the partition wall 21 that separates the cylinder bore 20A and the crank chamber 30A from the adjacent cylinder bore 20B and the crank chamber 30B.

Figure 5:
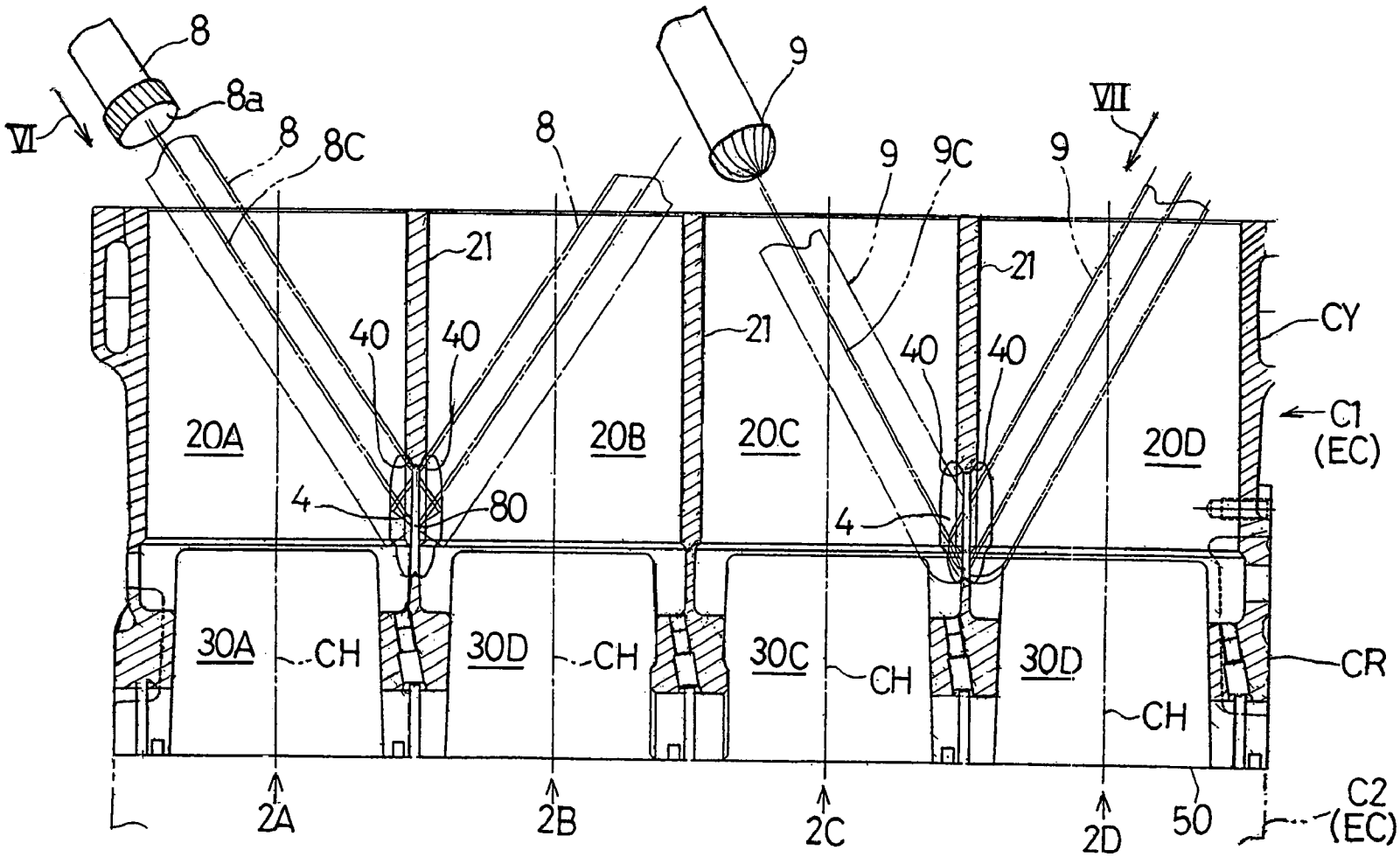
FIG. 5 is a schematic side sectional view, showing the manner in which machining is carried out to form the communication holes.

With the end mill cutter 8 driven, the lower region of the partition wall 21 is machined until a center 80 of the milling tip 8*a* (free end of the end mill) reaches a position shown by the double-dotted line in FIG. 5, that is, a position substantially aligned with, or a slight distance past, a point intermediate of the thickness of the partition wall 21, to thereby bore an upper half of the communication hole 4 and, at the same time, to form one end portion (left portion) of the uppermost edge 4*a* of such upper half of the communication hole 4.

Figure 6:
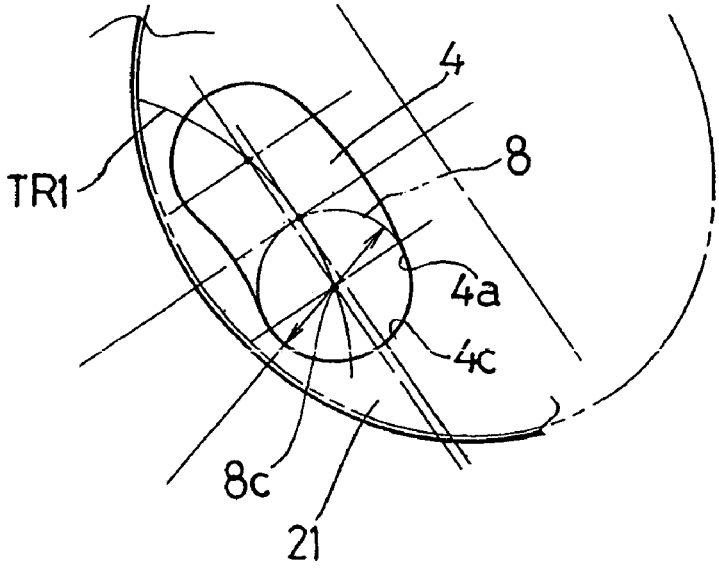
FIG. 6 is a diagram showing a portion of the communication hole as viewed in a direction shown by the arrow VI in FIG. 5.

At this time, as shown in FIG. 6 showing the communication hole 4 as viewed in a direction conforming to the direction of insertion VI of the end mill cutter 8, an upper half of the communication hole 4 including the uppermost edge 4*a* and upper halves of the opposite side edges 4*c* and 4*c* is formed by moving the end mill cutter 8 with the longitudinal axis 8C thereof following a path TR1 curved along a portion of the inner peripheral surface of the partition wall 21, which represents a portion of the cylindrical surface. The reason that the path TR1 is curved is because the communication hole 4 is formed along that portion of the inner peripheral cylindrical surface of the partition wall 21 with a major portion of the uppermost edge 4*a* rendered to be straight as hereinbefore described. It is, however, to be noted that the major portion of the uppermost edge 4*a* may be somewhat curved and any desired shape of the uppermost edge 4*a* can be formed by suitably selecting the path TR1.

Subsequently, as shown in FIG. 5, the end mill cutter 8 is inserted from above into the adjacent cylinder bore 20B of the second cylinder 2B with the end milling tip 8*a* oriented in a direction leftwardly diagonally downwardly towards the lower region of the partition wall 21 to thereby form the opposite end portion (right portion) of the lower half of the communication hole 4. In this way, the inclined surface areas 40 adjacent the respective opposite ends of the communication holes 4 are formed. The horizontal surface area 41 shown in FIG. 4 can be formed by manually milling with a hand-held grinder or machining technique. It is, however, to be noted that the horizontal surface area 41 is not always essential and may therefore be dispensed with, in which case the upper half of the communication hole 4 can be formed by the use of an end milling technique.

Procedures similar to those described above are equally applied to the partition wall 21 between the third and fourth cylinders 2C and 2D in FIG. 5 to thereby form the upper half of the communication holes 4 by the use of the end mill cutter 8 and a hand-held grinder. By so doing, the uppermost edge 4*a* of the communication hole having the inclined surface areas 40 and the horizontal surface area 41 is formed.

Figure 7:
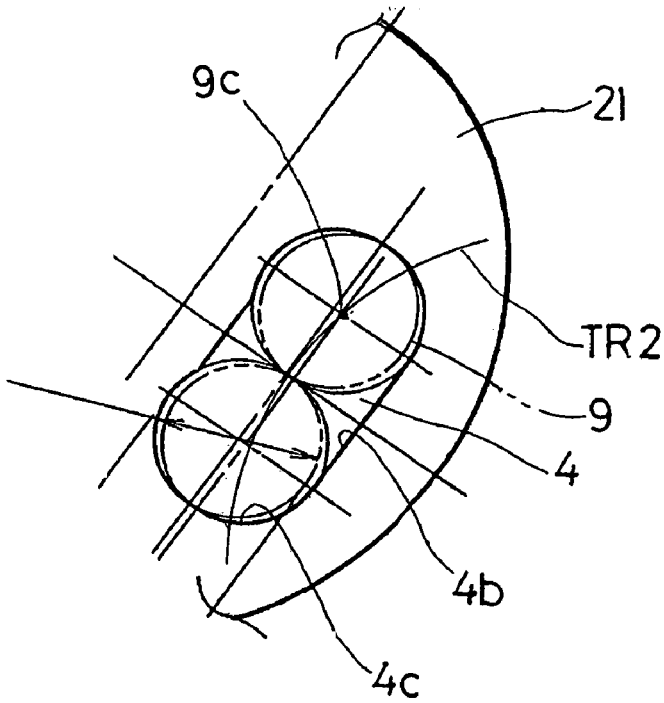
FIG. 7 is a diagram showing another portion of the communication hole as viewed in a direction shown by the arrow VII in FIG. 5.

Thereafter, an elongated ball end mill cutter 9 having a ball (rounded) milling tip 9*a* is inserted from above into the first and third cylinder bores 20A and 20C of the first and third cylinders 2A and 2C, with the ball milling tip 8*a* oriented in a direction rightwardly diagonally downwardly towards the lower region of the partition wall 21, to thereby form one end portion (left end portion in FIG. 5) of the lowermost edge of the lower half of the communication hole 4. At this time, as shown in FIG. 7 as viewed in a direction conforming to the direction of insertion VII of the ball end mill cutter 9, the lower half of the communication hole 4 including the lowermost edge 4*b* and the lower halves of the opposite side edges 4*c* and 4*c* is formed by moving the ball end mill cutter 9 with the longitudinal axis 9C thereof following a path TR2 along a portion of the inner peripheral surface of the partition wall 21, which represents a portion of the cylindrical surface.

In a manner similar to that described above, the opposite end portion (right end portion of FIG. 5) of the lowermost edge of the communication hole 4 is formed by means of the ball end mill cutter 9 inserted into the second and fourth cylinder bores 20B and 20D of the second and fourth cylinders 2B and 2D.

It is to be noted that FIG. 5 illustrates the first step of machining the partition wall 21 between the neighboring first and second cylinders 2A and 2B with the end mill cutter 8 and a second step of machining the partition wall 21 between the neighboring third and fourth cylinders 2C and 2D with the ball end mill cutter 9, as respective representative examples. Through those first and second machining steps, the communication holes 4 are formed respectively in those two partition walls 21.

Each of the communication holes 4 so formed as hereinabove described has the open edge portion 4*aa* of the uppermost edge 4*a* thereof positioned in the vicinity of the lower edge of the lowermost piston ring 34 when the corresponding piston is held in the bottom dead center position. Depending on the shape of the combustion engine E, however, each communication hole 4 may be formed by milling with the end mill cutter 8 or the ball end mill cutter 9 inserted from below (specifically from a joint surface 50 between the upper casing component C1 and the lower casing component C2) shown in FIG. 5. Also, in place of the end mill cutter 8, a machining tool referred to as a face mill cutter (T-slotter) may be employed.

As hereinbefore fully described, in the multicylinder four-cycle combustion engine according to the preferred embodiment, the communication holes 4 extending across the partition walls 21 between the first and second cylinders 2A and 2B and between the third and fourth cylinders 2C and 2D, respectively, by the use of the milling technique and, therefore, unlike those obtained by the use of a drilling technique, formation of the burrs around the open edge portions 4*aa*, 4*ab* and 4*ca*, shown in FIG. 3, of the communication hole during the machining can advantageously be suppressed. In particular, if each of the communication holes 4 is formed by milling from opposite directions as shown in and described with reference to FIG. 5, formation of those burrs can be substantially eliminated.

Also, the open edge portions 4*aa* of the uppermost edge 4*a* shown in FIG. 4, that is, a portion which most affects the flow of the gases G, are formed with the inclined surface areas 40 that are flared outwardly from an intermediate point of the associated partition wall 21. Therefore, the gases G can be smoothly guided through the respective communication hole 4 in response to up and down movement of the corresponding piston and, in combination with elimination of the burrs, the gases G can smoothly flow between the neighboring cylinders 2A and 2B or 2C and 2D through the associated communication hole 4.

In addition, since not only the open edge portions 4*aa* of the uppermost edge 4*a* of each communication hole 4, but also the open edge portion 4*ba* of the lowermost edge 4*b* of each communication hole 4 lies substantially horizontally, each communication hole 4 can have an increased passage area as compared with the round sectioned communication hole having the same size as measured in a direction conforming to the longitudinal axis of the cylinder and, accordingly, a substantial amount of gases G can be allowed to smoothly flow in a short time. As a result, the pumping loss can advantageously be reduced and the output and the efficiency of the combustion engine can be increased as well.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, although in the foregoing embodiment the present invention has been applied to the multicylinder four-cycle combustion engine for use in the motorcycles, the present invention can be equally applied to the multicylinder four-cycle combustion engine used in vehicles other than motorcycles, small marine vessels and power machinery for driving machines.

Accordingly, such changes and modifications are, unless they depart from the scope of the present invention as delivered from the claims annexed hereto, to be construed as included therein.

What is claimed is:

1. A multicylinder four-cycle combustion engine which comprises:

an engine casing having defined therein a plurality of cylinders, each having a cylinder bore, and a crank chamber below the respective cylinder bore, said cylinders being juxtaposed in a direction parallel to a longitudinal axis of a crankshaft, the neighboring cylinder bores and crank chambers being separated from each other by means of a partition wall;

the partition wall having a communication hole formed therein so as to extend completely across the partition wall; and a major portion of an open edge portion of an uppermost edge of the communication hole at a circumferentially intermediate portion, which open edge portion opens towards the cylinder bore, extending in a direction substantially perpendicular to a longitudinal axis of the cylinder.

2. The multicylinder four-cycle combustion engine as claimed in claim 1, wherein said communication hole is formed by means of a milling technique.

3. The multicylinder four-cycle combustion engine as claimed in claim 2, wherein said major portion of the open edge portion of the uppermost edge of the communication hole at the circumferentially intermediate portion is substantially straight.

4. The multicylinder four-cycle combustion engine as claimed in claim 3, wherein the straight major portion has a width which is equal to ½or more of the total width of the open edge portion.

5. The multicylinder four-cycle combustion engine as claimed in claim 2, wherein the uppermost edge of the communication hole is made up of opposite inclined surface areas, which are flared outwardly, and a horizontal surface area continued between the inclined surface areas, when viewed in a cross-section taken along a plane containing respective longitudinal axes of the neighboring cylinders.

6. The multicylinder four-cycle combustion engine as claimed in claim 2, the open edge portion of the lowermost edge of the communication hole, which opens towards the cylinder bore has a circumferentially intermediate major portion that extends in a direction substantially perpendicular to the longitudinal axis of the cylinder.

7. The multicylinder four-cycle combustion engine as claimed in claim 6, wherein the circumferentially intermediate major portion of the open edge portion of the lowermost edge of the communication hole is substantially straight.

8. The multicylinder four-cycle combustion engine as claimed in claim 2, further comprising crankshaft bearings each formed in a lower region of the respective partition wall.

9. The multicylinder four-cycle combustion engine as claimed in claim 2, wherein the communication hole is formed by milling with a milling tool inserted into the cylinder bore in a direction inclined relative to the longitudinal axis of the cylinder bore.

10. The multicylinder four-cycle combustion engine as claimed in claim 9, wherein the uppermost edge of the communication hole is formed by means of an end mill cutter and the lowermost edge thereof is formed by means of a ball end mill cutter.

11. In a multicylinder four-cycle combustion engine, the improvement comprising:

an engine casing having a plurality of cylinders, each having a cylinder bore for receiving a piston with a piston ring mounted on a crankshaft, the engine casing includes an integral portion of a crank chamber extending below the respective cylinder bores;

said cylinder bores being juxtaposed in a direction parallel to a longitudinal axis of a crankshaft, the adjacent cylinder bores and crank chamber portion being separated from each other by a plurality of partition walls, each partition wall having a communication hole formed therein so as to extend through the partition walls and having an approximately rectangular opening positioned between a lowermost movement position of the piston ring and above a crankshaft bearing.

12. The multicylinder four-cycle combustion engine as claimed in claim 11 wherein the communication hole has a chamfered surface with an outer edge surface forming an acute angle to the longitudinal axis.

13. The multicylinder four-cycle combustion engine as claimed in claim 11 wherein the communication hole has a flat upper horizontal surface and a lower horizontal ridge surface.

14. The multicylinder four-cycle combustion engine as claimed in claim 11, an uppermost edge of the communication hole is made up of oppositely inclined surface areas, which are flared outwardly, and a horizontal surface area continued between the inclined surface areas, when viewed in a cross-section taken along a plane containing respective longitudinal axes of the adjacent cylinders.

15. The multicylinder four-cycle combustion engine as claimed in claim 11 wherein the uppermost edge of the approximately rectangular opening becomes ovoidal at a mid-section of a thickness of the communication hole.

16. A multicylinder four-cycle combustion engine which comprises:

an engine casing having defined therein a plurality of cylinders, each having a cylinder bore, and a crank chamber below the respective cylinder bore, said cylinders being juxtaposed in a direction parallel to a longitudinal axis of a crankshaft, the neighboring cylinder bores and crank chambers being separated from each other by means of a partition wall;

the partition wall having a communication hole formed therein so as to extend completely across the partition wall; and a major portion of an open edge portion of an uppermost edge of the communication hole extends in a direction substantially perpendicular to a longitudinal axis of the cylinder, wherein the uppermost edge of the communication hole is made up of opposite inclined surface areas, which are flared outwardly, and a horizontal surface area continued between the inclined surface areas, when viewed in a cross-section taken along a plane containing respective longitudinal axes of the neighboring cylinders.

17. The multicylinder four-cycle combustion engine as claimed in claim 16 wherein a major portion of lowermost open edge portion of the communication hole extends in a direction substantially perpendicular to the longitudinal axis of the cylinder.

18. The multicylinder four-cycle combustion engine as claimed in claim 17 wherein the entrance, on the partition wall, of the communication hole has an approximately rectangular configuration.

19. The multicylinder four-cycle combustion engine as claimed in claim 18 wherein the uppermost thickness of the communication hole is thicker than the lowermost thickness.

* * * * *